United States Patent [19]

de Vos et al.

[11] 4,414,616

[45] Nov. 8, 1983

[54] OUTDOOR LUMINAIRE HAVING IMPROVED LATCHING MEANS FOR THE COMPONENT MOUNTING PLATE THEREOF

[75] Inventors: Hendrik A. J. de Vos; Elzear R. Labouliere, both of Swansea, Mass.

[73] Assignee: GTE Products Corporation, Stamford, Conn.

[21] Appl. No.: 240,521

[22] Filed: Mar. 4, 1981

[51] Int. Cl.[3] ..... F21V 15/04

[52] U.S. Cl. ..... 362/308; 362/310; 362/145; 362/223; 362/220; 362/347; 362/374; 362/375; 362/396

[58] Field of Search ..... 362/145, 147, 217, 220, 362/225, 277, 347, 349, 365, 366, 368, 370, 372, 362/374, 375, 308, 310

[56] References Cited

U.S. PATENT DOCUMENTS

| | | | |
|---|---|---|---|
| 3,201,581 | 8/1965 | Hirsch | 362/347 |
| 3,283,140 | 11/1966 | Rex . | |
| 3,328,574 | 6/1967 | Linse et al. | 362/217 |
| 3,350,556 | 10/1967 | Franck et al. . | |
| 3,377,477 | 4/1968 | Odle . | |
| 3,561,682 | 2/1971 | Rex . | |
| 3,604,921 | 9/1971 | Wood et al. | 362/374 X |
| 3,697,743 | 10/1972 | Eargle | 362/374 X |
| 3,745,326 | 7/1973 | Hernandez . | |
| 4,006,354 | 2/1977 | de Vos et al. . | |
| 4,019,044 | 4/1977 | Kelly et al. . | |
| 4,155,111 | 5/1979 | Kelly et al. | 362/374 X |
| 4,156,902 | 5/1979 | Wandler . | |
| 4,238,815 | 12/1980 | Price | 362/346 X |
| 4,245,284 | 1/1981 | Moore et al. | 362/370 X |
| 4,288,846 | 9/1981 | Fletcher et al. | 362/217 |
| 4,298,912 | 11/1981 | Dearth | 362/277 X |

FOREIGN PATENT DOCUMENTS

| | | |
|---|---|---|
| 1300615 | 4/1962 | Fed. Rep. of Germany . |
| 1435654 | 3/1966 | France . |
| 2071225 | 4/1971 | France . |

*Primary Examiner*—Peter A. Nelson

*Attorney, Agent, or Firm*—Lawrence R. Fraley

[57] ABSTRACT

A luminaire designed for outdoor applications (e.g., illuminating roadways and alleyways) and including an improved latching means in the form of two spaced-apart, depressible leaf springs, each including a cam surface for slidably engaging one of the sides of the luminaire's mounting plate during insertion thereof within the luminaire's housing to cause the biased spring to move to an open position (from its closed position) and thereafter clamp against the plate to effect positive retention thereof.

10 Claims, 8 Drawing Figures

OPEN POSITION "B"

CLOSED POSITION "C"

OUTDOOR LUMINAIRE HAVING IMPROVED LATCHING MEANS FOR THE COMPONENT MOUNTING PLATE THEREOF

DESCRIPTION

1. Technical Field

The invention relates to luminaires and particularly to luminaires designed for outside application. Even more particularly, the invention relates to such luminaires which utilize a high intensity discharge lamp and which provide light distribution patterns designed primarily for illuminating roadways, alleyways, etc.

2. Background

Outdoor liminaires are typically of ovate configuration and include an oval top part which houses the luminaire's reflector component, and an oval refracting lens which is usually hinged to the upper housing part and provides a closure therefor. Examples of such devices are illustrated in U.S. Pat. Nos. 3,283,140 (Rex), 3,377,477 (Odle), 3,350,556 (Franck), and 3,561,682 (Rex). It is also known in the art to provide luminaires of the above variety in non-ovate shapes such as the rectangular configuration shown in U.S. Pat. No. 4,028,541 (Franklin). In this latter device, the glass panel enclosure is also hingedly secured to the top housing.

One particular problem inherent in known outdoor luminaires of the variety above is the relative difficulty encountered in gaining access to the internal components thereof in the event that repair and/or replacement is necessary, said difficulty partly the result of the aforementioned hinged and similar arrangements between the housing and lens or glass enclosure. It is most often necessary in such devices to provide a separate means of access in addition to that for the device's light source to enable one to also remove or repair the ballast components located within the typical luminaire.

Another problem with a hinged lens or glasspanel arrangement is the possibility of forming an ineffective weather tight seal between these members. Absent such a seal, it is possible for water, dust particles, insects, etc. to enter the housing and possibly adversely affect its internal components. Attainment of an effective seal in this location of the luminaire is made all the more difficult in view of the relative fragility of such components and the ready possibility for causing harm thereto (e.g., fracture) in the event excessive force is applied, as might readily occur during closure.

Yet another disadvantage of known outdoor luminaires is the limited usage for each such device. More specifically, existing luminaires of this variety are typically capable of operating in only one position (usually either horizontal or slightly tilted upwardly therefrom) and thus do not lend themselves to more versatile mounting arrangements.

One added reason for the aforementioned difficulty in obtaining access to the internal luminaire components used in the above devices, particularly those ballast components associated with the luminaire's lamp for providing ignition thereof and for preventing self-destruction thereof by virtue of the lamp's negative resistance characteristic (below), may be found in the means by which the luminaire's mounting plate is secured within the housing of the device. Typically, this member is bolted in place, said means of securement deemed necessary to attain non-vibrating, positive retention of the plate and thus assure precise lamp alignment within the reflector component, should the plate have the socket as part thereof. It was therefore necessary to remove the securing bolts (or screws) each time access to the ballast components was necessary, an obviously time-consuming procedure. Whenever attempts have been made to provide a less restrictive means of retention, the end result has been a latching mechanism of relatively high complexity, thus also adding to the costs of manufacturing the device.

It is believed, therefore, that a luminaire capable of overcoming the aforementioned problems, disadvantages, etc. associated with existing, known such luminaires would constitute a significant advancement in the art. It is also believed that a luminaire providing the additional features and advantages defined in detail below would constitute an art advancement.

DISCLOSURE OF THE INVENTION

It is, therefore, a primary object of the invention to provide a luminaire which overcomes the several disadvantages above, thus enhancing the current state of the art.

It is another object of the invention to provide a luminaire which provides the several significantly advantageous features described hereinbelow, thus even further enhancing the art.

These and other objects are accomplished by the present invention wherein there is provided an improved latching means for use within a luminaire for securing the mounting plate member therein, said latching means comprising a pair of spacedly positioned depressible, resilient engagement members located on opposite sides of the luminaire's housing and biased in a first, closed position for engaging the mounting plate and moving against the biasing force to a second pin position during the engagement. The above movement can occur during both positioning of the plate within the housing as well as during removal thereof.

BRIEF DESCRIPTION OF THE DRAWINGS

FIGS. 4–6 represent the various mounting positions for the invention, FIG. 4 illustrating the vertical while FIGS. 5 and 6 illustrate the horizontal.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
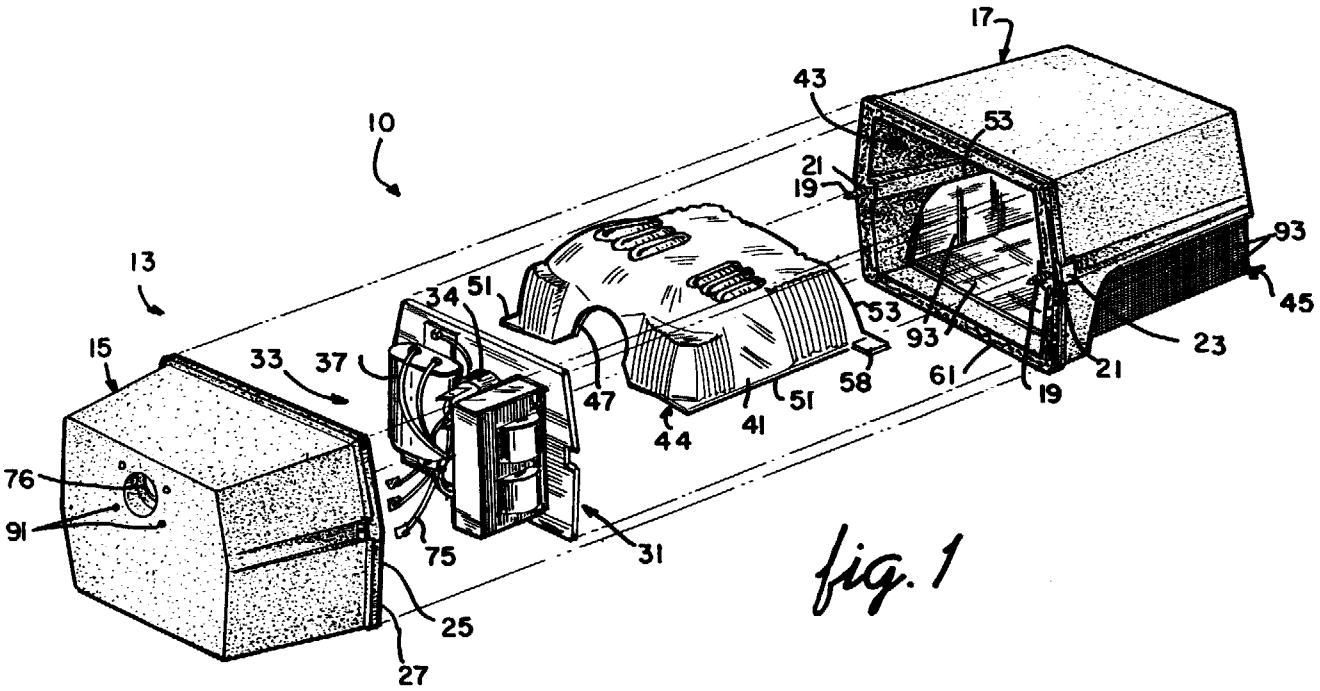
FIG. 1 is an exploded perspective view of a luminaire in accordance with a preferred embodiment of the invention.

With particular reference to FIG. 1, there is illustrated a luminaire 10 in accordance with a preferred embodiment of the invention. Luminaire 10, as will be further defined below, is particularly adapted for outdoor use (e.g., street and alley illumination) and is designed to provide light distribution patterns suitable therefor. The preferred patterns in such applications are IES (Illuminating Engineering Society) type II, type III, or type IV, although it is understood that luminaire 10 is capable of providing additional distributions.

Luminaire 10 includes a housing 13 which is comprised of two parts, a base or mountable portion 15 and a forward refracting portion 17 of unitary construction. The refracting portion 17 is readily separable from base 15 to permit quick access to the interior of housing 13 (and the various components therein, especially the luminaire's light source) for purposes of repair and/or replacement and, as will also be further explained below, to enable one to readily remove the luminaire's reflector should it be desired to substitute a different refracting portion and therefore provide a different scheme distribution patterns. As an example of what is meant by the term readily separable, the forward refracting portion 17 of housing 13 is attached to base portion 15 by only two screws 19 (see also FIG. 8) which pass through corresponding openings 21 each located within a flange 23 which in turn extends from one of two opposing sides of portion 17. Screws 19 align with and are finally secured within threaded openings 25 (see also FIGS. 3,7,8) which in turn are located on opposite sides of base 15. As shown in FIG. 1, base 15 also includes a flange 27 which extends about the periphery of the substantially rectangular opening 29 defined by this part of the housing. It can thus be understood from the foregoing that the forward portion of housing 13 can be removed completely from the remainder (base 15) in only a few seconds.

Figure 2:
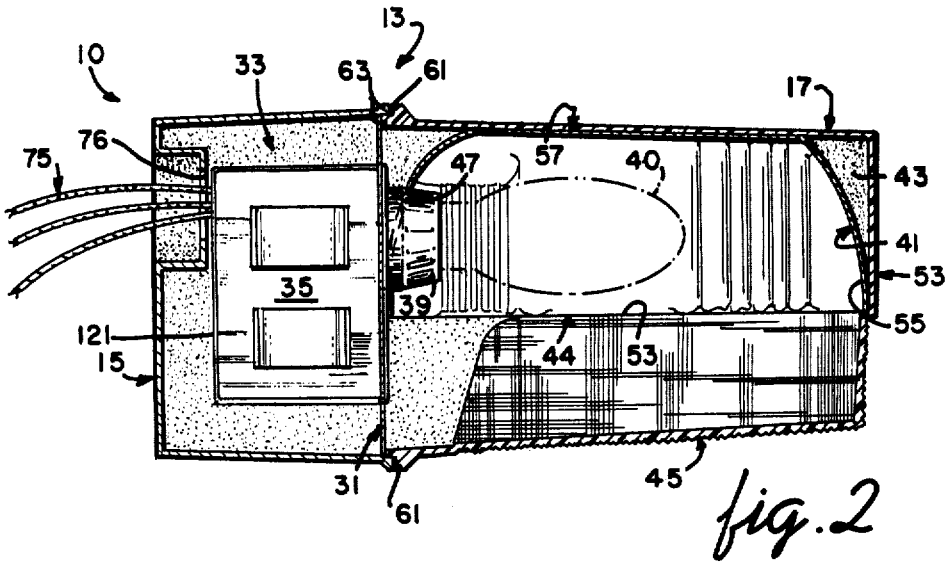
FIG. 2 is an enlarged, side elevational view, partly in section, of the luminaire of FIG. 1, as assembled, excluding the mounting elements which may be used therewith.
Figure 3:
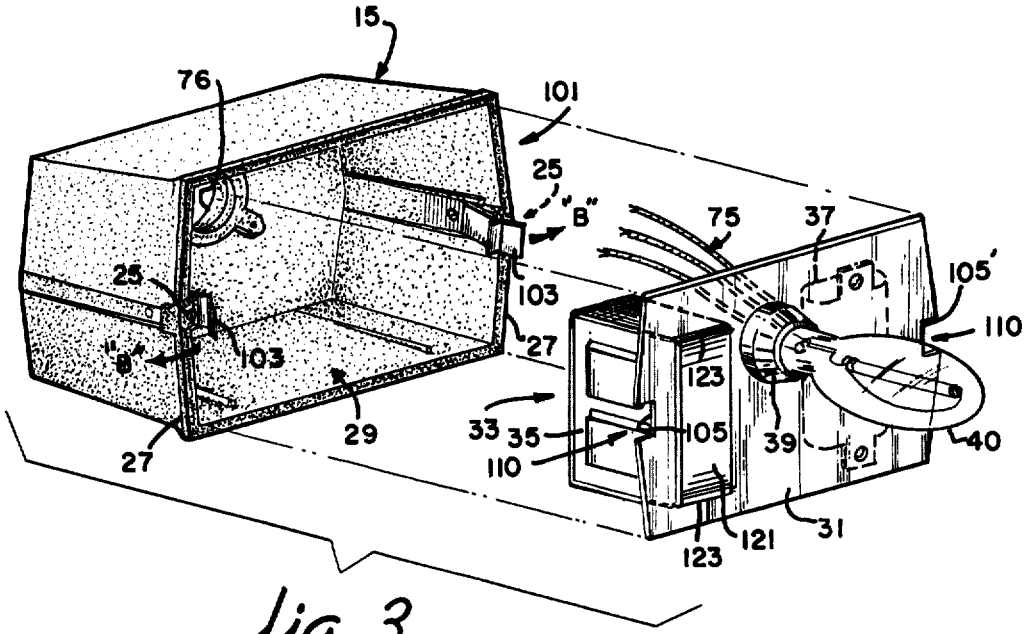
FIG. 3 is an exploded perspective view of the base portion of the invention's housing, and the mounting plate (with components secured thereto) which is adapted for being releasably positioned within the base.

Luminaire 10 further includes a component mounting plate 31 which is positioned within housing 13 and includes thereon the lamp ballast components 33 for use with the invention. These components include a ballast 35 and starter (lamp igniter) 37 which are located on opposite sides of the flat (planar) plate 31 and separated by a socket 39 in which is positioned the desired light source for use with the invention. The preferred light source is a high intensity discharge (HID) lamp 40 (FIGS. 2,3). HID lamps are those having a gaseous discharge arc tube and operate at pressures and current densities sufficient to generate the desired amount of visible radiation within the respective arcs. Such lamps are popular in the outdoor lighting field because of their high efficacy (more lumens per watt of consumed power), long operating life and sound lumen maintenance, and compactness of design, HID lamps generally fall within one of three categories: mercury lamps (typically containing a small quantity of mercury and a suitable starting gas such as argon within their arc tube), metal halide lamps (including mercury and argon, as above, in addition to a mixture of metallic iodide additives such as sodium, thallium, or indium), and high pressure sodium lamps (containing mercury and sodium, in addition to xenon which is ionized by a short high voltage pulse). Of these, the most preferred is a high pressure sodium lamp and even more particularly, one designed to be extremely energy efficient. Specifically, the high pressure sodium lamps preferably used in the invention produce 50, 70, or 100 watts and operate at voltage levels of 120, 208, 240, and 277 volts. In one specific example, lamp 40 produced 70 watts while operating at normal line voltage (120 volts). The ballast member 35, needed as a current limiter to prevent self-destruction because of the negative resistance characteristic (as the current therethrough increases, the lamp's resistance decreases) of HID lamps, is rated at 120 v. 60 Hz, and 1.6 Amps, and can be purchased from the Advance Transformer Company, Chicago, Ill., under catalogue number 71A7900. The preferred starter (igniter) 37, needed to provide the aforedefined short, high voltage pulse, is also available from the Advance Transformer Company, under catalogue number L1-551-B5.

Lamp 40 is positioned within a porcelain socket 39 which, as stated, is substantially centrally positioned within component plate 31. Socket 39 is pulse rated at 4 K.V., and also possesses a 660 Watt—600 V. operational rating.

In addition to the above components, luminaire 10 further includes a reflector 41 which is positioned within the refracting portion 17 of housing 13 such that lamp 40 is recessed therein (FIG. 2). Reflector 41 is of generally rectangular configuration and is located within an opaque chamber portion 43 of this refracting part of the housing. Reflector 41 is preferably highly polished or vacuum metallized aluminum having many highly reflective interior surfaces of spherical, cylindrical, and parabolic shapes, arranged in a predetermined manner to direct light from lamp 40 through a light-transmitting, prismatic lens 45 (the reflector's rectangular opening 44 facing lens 45) located immediately adjacent opague chamber 43 to provide one of the two schemes of light distribution patterns described below. The rear portion of reflector 43 includes a recess 47 therein designed to accommodate socket 39 (FIG. 2) such that the envelope of lamp 40 can extend (or project) within and be surrounded by the reflector in the manner shown. As indicated below, the reflector and lens components of the invention combine to provide two schemes of light distribution. Assuming that luminaire 10 is providing one of these and it is desired at the location in which the invention is utilized to change to the other, it is only necessary to separate the two part housing 13, remove reflector 41, and replace the refracting portion 17 with one possessing the refracting characteristics desired. The new portion 17 will, understandably, be similar in configuration to the original (so as to mate with base 15 and accommodate reflector 41) except for its refracting capabilities. Reflector 41 thus serves as a common component for both housings formed and never needs replacement except in situations of repair. This procedure is facilitated by the fact that reflector 41 is only slidably located within portion 17 of housing 13 and can thus be quickly removed. More specifically, the reflector includes a flange 51 along both opposing sides thereof, each of which mates with and slides along a corresponding ledge 53 formed by lens 45. Reflector 41 is thus simply slid within refracting portion 17 of housing 13 until its forward edge 53 engages an internal, forward wall 55 of portion 17. In this position, the reflector's top surface 57 abuts the interior of the top wall of portion 17 (FIG. 2) such that the reflector assumes a relatively snug (though readily removable) position therein. This snug type of retention is further assured by provision of a pair (one shown) of projecting tabs 58 which can extend from a respective flange 51 at the forwardmost portion of reflector 41. Tabs 58 add to the overall forward width of the reflector such that an interference fit will be achieved between this part of the reflector and the inside of the refracting portion 17 (at the forwardmost end) when the reflector is in its final position in portion 17. It is understood that the aforedescribed fit still enables one repairing luminaire 10 or substituting a new forward portion 17 to readily remove the reflector by simply grasping the exposed, rear end portion thereof and, firmly, pulling the reflector out of portion 17. It is also preferred in the invention to slightly taper (front to back) the forward refracting portion 17 as well as the reflector to further assure the snug fit described above. This tapered relationship is best illustrated in FIG. 2.

With particular attention to FIG. 3, the component mounting plate 31 of the invention is shown as being secured within base portion 15 of the invention's housing such that it is partially recessed therein (FIG. 2). In this position, the aforedescribed ballast components are oriented within the boxlike base and thereby separated from the remaining components (e.g., lamp 40, reflector 41, and lens 45) by the planar plate member 31. Plate 31 thus serves as a cover for the rectangular, planar opening 29 defined by boxlike portion 15. It can therefore be seen that when the refracting portion 17 of housing 13 is separated from base 15, lamp 40 can be quickly removed without the necessity for performing additional manipulations such as loosening, pivoting, or even total removal of the plate member. It is thus only necessary to remove two screws (19) before one has access to the lamp of the invention in the event that replacement thereof is necesary. To assure a weathertight seal between both parts of housing 13, a neoprene gasket 61 is employed and positioned about a collar 63 formed on flange portion 23 and surrounding the planar, rectangular opening defined by the forward refracting portion 17, which, like base 15, is also of boxlike configuration. With gasket 61 thereon, collar 63 is adapted for being snugly inserted within the corresponding rectangular opening 29 in base 15 in the manner depicted in FIGS. 2 (and 8). Screws 19 are thereafter tightened, forming a weathertight seal between both housing parts. Gasket 61 is understandably also of substantially rectangular configuration. A further description of this unique means of providing a seal is provided below with the description of FIG. 8.

Figure 4:
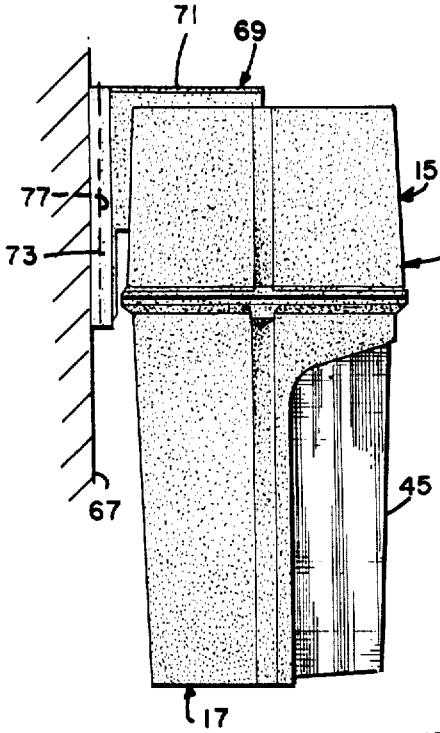
Figure 5:
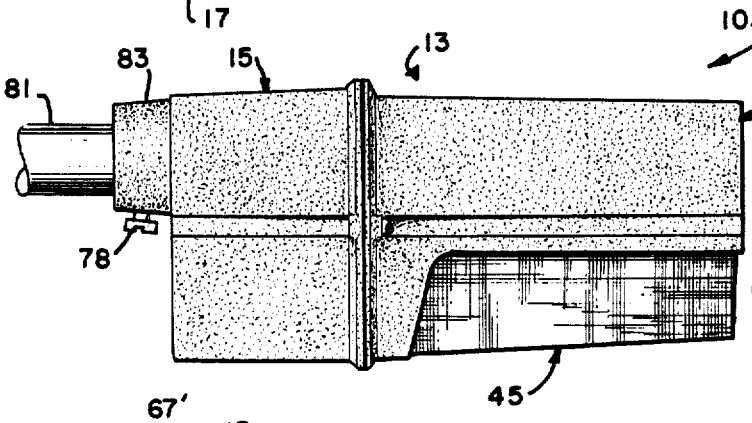
Figure 6:
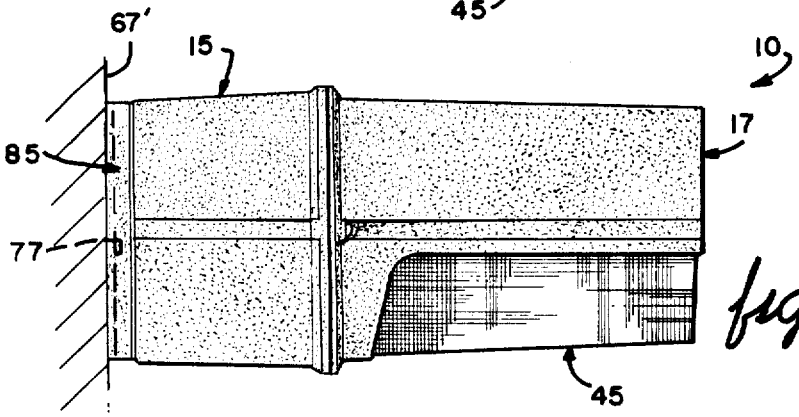

With particular reference to FIGS. 4–6, there are shown various possible mounting positions for luminaire 10. In FIG. 4, luminaire 10 is illustrated in a vertical position with base portion 15 of housing 13 secured (e.g., bolted) to a wall 67. To provide this orientation, a wall mounting member 69 is utilized, said member of substantially L-shaped configuration having a horizontal (upright) arm 71 secured (e.g. bolted) to the back (or top) wall of base 15 and a vertical arm 73 for lying flush to wall 67. The wiring 75 (FIGS. 1–3) used in luminaire 10 to electrically connect the invention to the corresponding line current necessary for its operation passes through a slot or similar opening (not shown) in the upright arm 71 (after initially passing through an aperture 76 within the back wall of base 15) and thereafter through an opening (not shown) in the flush-mounted arm 73, where it can be connected to corresponding wiring located within wall 67. In this arrangement, it is preferred to utilize a planar mounting plate 77 (hidden) which is first secured (e.g., bolted) to wall 67. Plate 77 includes a central aperture (not shown) therein to permit the desired wiring to pass therethrough. Accordingly, the arm portion 73 of member 69 is designed (includes opposing flanges to define a channel therebetween) to slide over the outer surfaces of plate 77 and thereafter be secured in fixed relation thereto (e.g., using a bolt which passes through an opening in arm 73 and into a corresponding recess in one of the plate's side surfaces). To further facilitate this positioning, both plate 77 and arm 73 can be similarly tapered. It is understood that this positioning occurs subsequent to attachment of member 69 to luminaire 10, thus eliminating the requirement for one installing the unit to simultaneously hold the unit and attempt securing member 69 to wall 67. Mounting of luminaire 10 is therefore a relatively simple and safe procedure. In the position depicted in FIG. 4, it is understood that the lamp 40 (not shown) of the invention is oriented in an inverted manner (envelope facing down). This does not adversely affect the operation of luminaire 10, however, in view of the ability of the lamp to operate equally as efficiently and effectively in this position as it does when horizontally arranged or slightly tilted upward from horizontal (as is typical in most known outdoor luminaires). When luminaire 10 is vertically positioned as in FIG. 4, the light emitted therefrom is primarily in a forward and downward direction to produce the desired IES distribution below the luminaire. A typical mounting height (distance from ground to lens 45) is within the range of ten to twelve feet.

In FIGS. 5 and 6, luminaire 10 is depicted in its two horizontal mounting positions. With particular reference to FIG. 5, the invention is shown secured to a pole 81 using a slipfitter 83 which in turn is attached (e.g., bolted) to base 15 of housing 13. The invention's wiring 75, after passing through aperture 76 in base 15, passes through an opening (not shown) in slipfitter 83 and then into pole 81 where it is connected to the respective wiring therein. To prevent moisture, insects, dust, etc. from passing into base portion 15 at this location, it is preferred to employ a neoprene gasket (not shown) which is positioned between the rear wall of base 15 and the slipfitter 83 (e.g., in mating recesses located in each) and includes an opening therein through which pole 81 may pass so as to be partly inserted within base 15 (in the rear indentation portion depicted in FIG. 2). Final securement of pole 81 relative to the slipfitter and base 15 can be achieved by set screw 78 which passes through the slipfitter's outer wall and engages a corresponding exterior surface of pole 81.

With particular attention to FIG. 6, luminaire 10 is positioned horizontally and, instead of being secured to a pole, is attached to a wall 67' using the aforedescribed mounting plate 77 (hidden) which is attached (e.g., bolted) to the wall in the flush arrangement shown. Base 15 may thereafter be slidably located on plate 77 in much the same manner as described above in FIG. 4. Specifically, a planar mounting member 85 is employed and attached to the back wall of base 15 (e.g. using bolts). Member 85 includes opposing flanges (not shown) which define a channel therebetween. The flanges slidably engage opposing (side) surfaces of plate 77 during positioning. In such an arrangement, it is also preferred (as above) to taper the opposing side surfaces (one facing the viewer in FIG. 6) of plate 77 as well as the flanges of member 85 such that the member will rest snugly when in its final, secured position. The invention's wiring 75 passes through base aperture 76 (as above) and thereafter through an opening (not shown) in the flush plate 77. Connection is thereafter achieved with the respective wiring in wall 67'.

It is understood with regard to all of the aforedefined mounting orientations that the various mounting items (L-shaped member 69, slipfitter 83, and planar member 85) are attached at the respective locations (walls 67, 67', pole 81, and base 15) using suitable gasketing sufficient to provide an adequate weathertight seal at said locations and therefore prevent exposure of wiring 75 and the internal components (33) of the invention to such adverse elements as moisture, dust, etc. In addition, attachment of the above items is facilitated by the provision of several (e.g., four) holes 91 (FIG. 1) in the back wall of base 15 and also providing a similar number arranged in an identical pattern within the corresponding mounting item. It is therefore only necessary for the installer of the invention to align these hole patterns, pass the desired mounting bolts therethrough, and attach corresponding nuts and washers as needed.

One of the truly advantageous features of the invention is that it is extremely lightweight in comparison to most known outdoor luminaires. By way of specific example, housing 13, when using the materials specified below, weighs only about two pounds and eight ounces, with the unitary, plastic refracting portion 17 accounting for only about one pound, two ounces of this, and base 15 the remainder. Reflector 41, being aluminum as described, weighs only about six ounces, while mounting plate 31, having the aforedescribed ballast, igniter, and socket components secured thereto, weighs only four pounds, twelve ounces. The entire luminaire, excluding lamp 40 and the various mounting items shown in FIGS. 4–6, thus weighs only about seven pounds and ten ounces, and it must be emphasized that a significant portion of this total weight is due to the presence of the ballast transformer 35, itself a typically heavy component. Excluding this component and mounting plate 31 (as well as the other components secured thereto), the total weight of housing 13 and reflector 41 is, remarkably, less than three pounds.

As stated, housing 13 is of two-part (forward, refracting portion 17 and base portion 15) construction with each part being of substantially boxlike configuration. To provide the above reduction in weight and the several advantages associated therewith (including the following), both parts are manufactured from different materials with those of forward, refracting portion 17 being the lightest. More specifically, base portion 15, adapted for being secured to the aforedefined pole or wall members using the described mounting items, is metallic, and preferably die-cast aluminum. Use of such material assures that this portion of housing 13 will not only be lightweight but also sturdy and rugged, thus able to withstand the relatively high forces exerted thereagainst as typically found in the outdoor environment as well as those encountered during positioning and repair of the luminaire. In comparison, refracting portion 17 is of plastic material and, surprisingly, of a unitary construction such that the prismatic lens 45 and the remainder opaque chamber portion 43 of this component are formed simultaneously from the same material. The material for portion 17 is a thermoplastic, and more preferably, polycarbonate. This entire member is formed using an injection molding procedure, afterwhich the desired opaque chamber portion is painted (lens 45 having been properly masked). It is therefore only necessary to paint either the interior or the exterior unmasked surfaces of this portion of housing 13. In like fashion, the metal (aluminum) base portion 15 is also painted, preferably with the same paint used on the refracting portion.

As shown, both the internal and external surfaces of lens 45 include several individual prisms 93 therein which are arranged in a predetermined manner to coordinate with the spherical, cylindrical, and parabolic reflecting portions of reflector 41 to produce the pattern desired. A better understanding of how these elements of the invention combine to provide the results achieved is provided in the copending application under Ser. No. 240,343, filed Mar. 4, 1981 and entitled "Luminaire Adapted For Horizontal And Vertical Operation" (H. A. J. deVos et. al.). The important feature to note is that combining these elements in the manner defined enables the invention, quite surprisingly, to produce either a type II or III distribution while the luminaire is mounted in the horizontal and a type IV distribution in the vertical. This feature is deemed truly unique in that it assures the invention a degree of mounting versatility heretofore unknown. In addition, to change from one scheme (e.g., type II and IV) to the other (type III, IV), it is only necessary to separate the extremely lightweight refracting portion 17 from base 15, slidably remove reflector 41 from within portion 17, and replace portion 17 with one capable of providing the pattern desired. Such a replacement is of substantially similar external configuration to its predecessor (excluding the lens pattern) so no further adjustments, alterations, etc. are required. The entire procedure take only a few seconds, unlike the several minutes envisioned to perform a similar operation for outdoor luminaires of the known art.

In order to permit manufacture of a relatively complex structure (having several precisioned lens elements) such as refracting portion 17 using an injection molding procedure (which enables mass production of the invention in large quantities, thus significantly reducing the cost thereof), each of the individual prisms 93 along the interior surface of light-transmitting lens 45 run lengthwise (from the front F of the lens toward the back, base portion 15) thereof, thus allowing facile mold plunger withdrawal. In contrast, those prisms 93 formed within the four external surfaces of the four-sided lens 45 run transverse to their internal counterparts (as indicated clearly in the cross-sectional view shown in FIG. 2). These external prisms are of substantially identical widths to provide a smoothing effect on the outgoing light. It is also significant to note that lens 45 does not include a house (or base) side refracting component (wall). This feature eliminates the need for such an added element and thus allows the opaque portions of the housing to define the desired cut-off of light in this region of luminaire 10. This characteristic is totally unlike most known outdoor luminaires which, as stated, utilize a bowl-shaped lens, as well as a corresponding bowl-shaped upper housing, thus relying on subtractive means (the house side of the lens being required to divert light away from said side) to control illumination to the house side areas. In summary, through the use of radial lens elements in combination with corresponding reflecting surfaces of the different configurations cited above, the invention is able to accomplish with a plane surface (refracting component 45 in FIG. 2) substantially the same results as heretofore provided by often complex, bowl-shaped lens members.

One truly unique feature of the unitary refracting portion 17 is the elimination of the requirement to provide a gasket between the lens and housing members, heretofore deemed essential in known luminaires by virtue of the individual construction thereof. Understandably, an improper seal between such members enables moisture, dust, etc. as typically found in an outdoor environment to enter the luminaire and possibly adversely affect the components therein (e.g., cause lamp 40 to fracture, reduce the reflecting characteristics of reflector 41, etc.). Such a possibility is eliminated by the invention wherein the forward portion 17 of housing 13 is a singular component and therefore formed of the same material.

In addition to the above, use of a substantially lightweight material (thermoplastic) for this entire portion of luminaire 10 assures a reduced moment arm at the end of the luminaire's housing, particularly when the invention is horizontally oriented as in FIGS. 5 and 6. This feature in turn reduces the potential stresses exerted on both base 15 and the corresponding wall or pole to which the base is secured. Still further, use of a lightweight refracting member assures a positive seal between both housing parts by use of only the two retention screws shown, particularly as a result of base 15 being secured as indicated.

Figure 7:
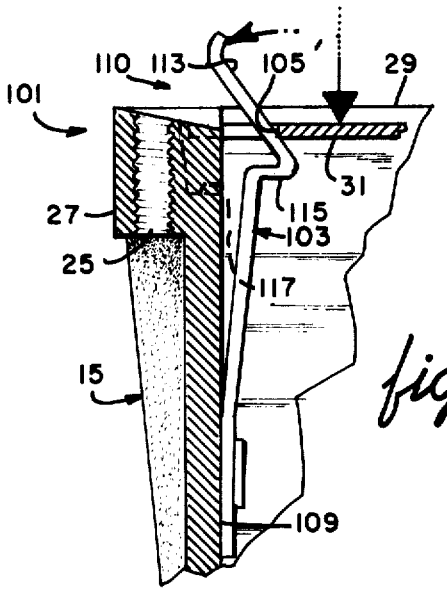
FIGS. 7 and 8 illustrate the various steps in positioning of the invention's mounting plate within the base portion of the invention's housing.
Figure 8:
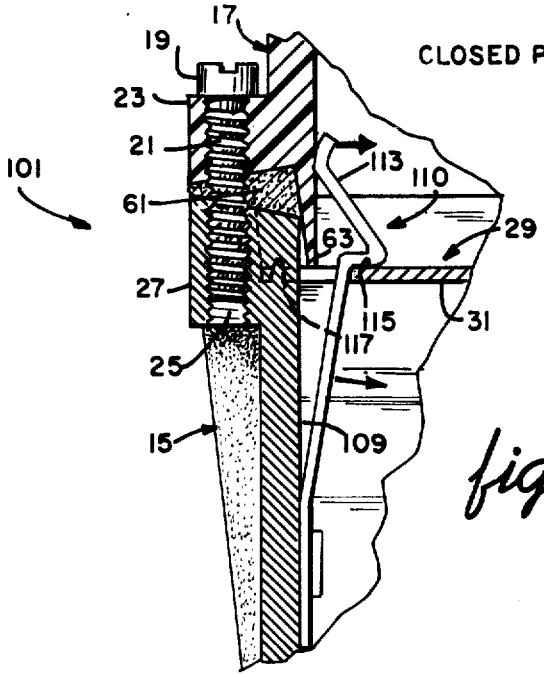

With added particular reference to FIGS. 3,7, and 8, there is illustrated a latching means 101 in accordance with a preferred embodiment of the invention, said means 101 providing releasable securement of the planar component mounting plate 31 (with ballast components 33 thereon) within base 15 such that the plate properly covers the rectangular opening (29) defined by this boxlike portion of the inention's housing. Latching means 101 includes a pair of opposingly oriented depressible, resilient members 103 which engage opposite edges 105 and 105' of plate 31 during positioning of the plate. Members 103, each a leaf spring member attached (e.g., bolted or welded) to an internal surface 109 of base 15, are biased in a first, closed position "C" and thereafter forced to a second, open position ("B") when engaged by edges 105 and 105'. An enlarged, more detailed view of this type of engagement and eventual securement is shown in FIGS. 7 and 8. As shown therein, plate 31 includes a three-sided indentation 110 within each of the opposite sides thereof with each of said engaging edges (105' in FIGS. 7,8) comprising one of the three sides thereof, preferably the bottom. Accordingly, each leaf spring 103 aligns with a respective indentation 110 during plate positioning and includes a forward cam surface 113 which, when slidably engaged by edge 105', is forced to the open position. The biasing force exerted by spring 103 toward the closed position "C" is thus overcome by the greater force created by this engagement, said force acting opposite to the biasing force.

As also shown in FIGS. 7 and 8, each leaf spring 103 further includes a recessed portion 115 adjacent (behind) the cam surface 113 and designed to positively engage the front surface of plate 31 (FIG. 8) to thus clamp the plate against base 15. To facilitate this positioning, base 15 includes an upstanding ledge 117 on which the portions of plate 31 immediately surrounding indentation 110 are seated. An engaging surface of spring 103 thereby positively holds plate 31 downward on ledge 117 such that the plate is recessed somewhat within base 15 so as to provide the described cover for rectangular opening 29. To remove plate 31, it is only necessary to depress each spring 103 to the open position and lift the plate in an outward direction from opening 29 or to exert an upward force on the plate itself. This unique form of releasable securement not only assures positive retention of plate 21 within base 15 but also assures precisioned alignment thereof such that socket 39 (having lamp 40 therein) will be accurately oriented. It can be clearly understood that even slight misorientation of the plate (and therefore socket 39) can in turn misalign the arc tube of lamp 40 relative to the several reflective surfaces of reflector 41 and therefore possibly alter the illumination levels at locations on the distribution pattern below the invention. Such misalignment is prevented by latching means 101 which provides for both lateral and depth positioning of plate 31. As described, means 101 does so in a manner which enables quick removal of the plate to thereby allow for facile repair and/or replacement of the invention's ballast components, wiring, etc. Such a unique means of plate securement also understandably facilitates assembly of luminaire 10, thus further reducing manufacturing costs thereof.

One of the openings 25 is also shown in greater detail in FIGS. 7 and 8, each of said openings designed to accommodate a respective one of the two screws 19 for securing the two parts of housing 13 together along the common, planar open end portions thereof. Opening 25 is located within the flange 27 which encompasses the open end 29 of base 15. As also illustrated in FIG. 8, refracting portion 17 of housing 13 is indicated in its final, secured position against base 15. It can be seen that collar 63 extends within opening 29 of base 15 sufficiently to engage an outer surface of plate 31 and thus provide additional retention thereof in the assembled product. Collar 63 also serves to control the amount of compression force exerted which can be against gasket 61 during tightening of screw 19. As further shown in FIG. 8, the corresponding opposing, outer surfaces of flange portions 23 and 27 are sloped to assure that gasket 61 will be moved inwardly (toward interior of housing 13) during compression and thus provide the most effective means of sealing. This arrangement assures that compressed gasket material will not project externally of the housing and thereby provide an unsightly appearance in the completed product.

It is of course understood that the leaf spring 103 shown in FIGS. 7 and 8 is identical to its counterpart located on the opposite side of base 15 but is reversed in orientation in comparison thereto. This opposing, spaced arrangement of both members is more clearly illustrated in FIG. 3. The preferred material for each spring 103 is 0.025 inch thick stainless steel. Dimensionwise, each spring has an overall (before forming to the configuration illustrated) length of 1.50 inch and a width of 0.375 inch. Understandably, each indentation 110 is only slightly wider.

The preferred means of securing the ballast transformer 35 to plate 31 is also depicted in FIGS. 2 and 3. More particularly, ballast 35 is held against the flat back surface of plate 31 by a strip of metal strapping 121, which passes through spaced slots 123 within plate 31 to positively engage the forward surface of the pate and provide the retention desired. The metal strip is overlapped and secured in a manner conventional to strapping techniques and is thus not illustrated here. Such a technique provides positive securement of ballast 35 and is relatively inexpensive in comparison to most known mounting procedures (which typically require several manual manipulations, including bolt aligning and fastening). The preferred strapping material is stainless steel, said material having a thickness of about 0.016 inch and a width of 0.375 inch. To provide added fastening thereof, a second metal strap member (not shown) is utilized and crimped over the secured portions of the strapping. Use of this additional member has proved to provide the added securement which may be necessary in situations of high vibration, etc.

While there have been shown and described what are at present considered the preferred embodiments of the invention, it will be obvious to those skilled in the art that various changes and modifications may be made therein without departing from the scope of the invention as defined by the appended claims.

We claim:

1. In a luminaire including a housing member, a reflector positioned within said housing member, a lamp located within said housing member relative to said reflector, a component mounting plate having lamp ballast components secured thereto and a socket member located therein and having said lamp positioned within said socket member, and latching means for securing said component mounting plate within said housing, the improvement wherein said housing is comprised of a base portion and a forward refracting portion secured to said base portion and readily separable therefrom, and said latching means comprises a pair of depressible, resilient engagement members spacedly oriented within said base portion of said housing for engaging opposite sides of said component mounting plate to hold said plate in releasable securement to said base portion of said housing such that said lamp will be accurately oriented within said forward refracting portion of said housing relative to said reflector, each of said resilient engagement members being biased in a first, closed position and movable against said biasing force in the opposite direction to a second, open position when engaged by said mounting plate during positioning and removal thereof within said base portion of said housing, said forward refracting portion of said housing member engaging said mounting plate and each of said resilient engagement members when said forward refracting portion is secured to said base portion of said housing member to assist in maintaining each of said resilient engagement members in said first, closed position against said mounting plate thereby assisting in retaining said mounting plate against said base portion.

2. The improvement according to claim 1 wherein each of said depressible resilient engagement members comprises a leaf spring having a cam surface for slidably engaging a respective one of said opposite sides of said mounting plate during said positioning and removal.

3. The improvement according to claim 2 wherein each of said leaf springs includes a recessed portion adajcent said cam surface for clamping about said respective opposite side of said mounting plate when said mounting plate is positioned within said housing and said leaf spring occupies said first, closed position.

4. The improvement according to claim 2 wherein said mounting plate includes a pair of indentations located within opposite sides thereof, each of said leaf springs being aligned within a respective one of said indentations and slidably engaging at least one surface thereof during said positioning and removal of said plate.

5. The improvement according to claim 2 wherein said mounting plate is substantially planar.

6. The improvement according to claim 5 wherein said base portion of said housing member is of substantially boxlike configuration and includes a planar open end, said mounting plate being positioned within and providing a closure for said open end.

7. The improvement according to claim 6 wherein said mounting plate is of substantially rectangular configuration.

8. The improvement according to claim 1 wherein said mounting plate is capable of being positioned within and removed from said housing member while said lamp is positioned within said socket.

9. The improvement according to claim 1 wherein said lamp ballast components include a ballast and a lamp starter, said ballast secured to said mounting plate by metal strapping.

10. The improvement according to claim 1 wherein said forward refracting portion of said housing includes a tapered collar portion, said collar portion engaging said mounting plate and each of said depressible engagement members to assist said depressible engagement members in retaining said mounting plate against said base portion of said housing.

* * * * *